US005363344A

United States Patent [19]

Sofen

[11] Patent Number: 5,363,344

[45] Date of Patent: Nov. 8, 1994

[54] ACOUSTIC SENSOR HAVING A SHELL-MOUNTED TRANSDUCER

[76] Inventor: Michael E. Sofen, 2174 Golf Course Rd., Friday Harbor, Wash. 98250

[21] Appl. No.: 84,420

[22] Filed: Aug. 10, 1987

[51] Int. Cl.[5] ..... H04R 17/00

[52] U.S. Cl. ..... 367/157; 367/165; 310/337

[58] Field of Search ..... 367/157, 169, 165, 152, 367/159, 160, 180; 310/337, 800; 73/DIG. 2; 381/190; 128/24 A, 660

[56] References Cited

U.S. PATENT DOCUMENTS

| | | | |
|---|---|---|---|
| H391 | 12/1987 | Henriquez et al. | 367/159 |
| 3,332,057 | 7/1967 | Pavey, Jr. | 367/159 |
| 3,333,236 | 7/1967 | Schloss | 367/165 |
| 3,360,773 | 12/1967 | Hensley, Jr. | 367/180 |
| 3,561,268 | 1/1969 | Massa | 367/134 |
| 3,583,677 | 6/1971 | Phillips | 367/162 |
| 3,710,151 | 1/1973 | Massa et al. | 310/348 |
| 3,713,086 | 1/1973 | Trott | 310/348 |
| 3,749,948 | 7/1973 | Morris | 310/326 |
| 3,760,348 | 9/1973 | Kieser et al. | 367/157 |
| 3,805,226 | 4/1974 | Holloway | 367/157 |
| 3,889,230 | 6/1975 | Knott et al. | 367/181 |
| 4,163,206 | 7/1979 | Hall, Jr. | 367/160 |
| 4,193,130 | 3/1980 | Young et al. | 367/149 |
| 4,236,235 | 11/1980 | Gilbert | 367/157 |
| 4,271,490 | 6/1981 | Minohara et al. | 367/122 |
| 4,376,302 | 3/1983 | Miller | 367/157 |
| 4,389,580 | 6/1983 | Walton et al. | 307/400 |
| 4,435,794 | 3/1984 | Marshall, Jr. et al. | 367/155 |
| 4,446,544 | 5/1984 | Connolly, Jr. | 367/155 |
| 4,525,645 | 6/1985 | Shirley et al. | 310/337 |

FOREIGN PATENT DOCUMENTS

| | | | |
|---|---|---|---|
| 2042256 | 9/1980 | United Kingdom | 310/800 |

OTHER PUBLICATIONS

Information Sheet: reprint from Jun. 14, 1984 EDN by Pennwalt Corporation, King of Prussia, Penna. 19406; one page.

5 pages relating to Transducer Tempcon 81 Conference; Jun. 11, 1981.

Information Sheet: "Model 6600 Transducer", EDO Corporation, Western Division, 2645 South 300 West, Salt Lake City, Utah 84115.

Product Brochure TR-10-M-6-83-PF101, KYNAR Piezo Film, Pennwalt, 7 pages.

Information Sheets: "ITC Hydrophones", International Transducer Corporation, 3 pages.

Michael A. Marcus, "Ferroelectric Polymers and Their Applications," paper presented at Fifth International Meeting on Ferroelectricity at Pennsylvania State University, Aug. 17-21, 1981; 11 pages.

Gordon Graff, "Piezopolymers: Good Vibrations", *High Technology*, Jun., 1986, pp. 60-62.

*Primary Examiner*—J. Woodrow Eldred

*Attorney, Agent, or Firm*—Christensen, O'Connor, Johnson & Kindness

[57] ABSTRACT

An acoustic sensor is disclosed that exhibits a wide linear bandwidth, provides a high signal-to-noise ratio, and that is rugged and relatively inexpensive. The sensor includes a piezoelectric polymeric tape transducer adhered to a portion of the inner surface of an acoustically transmissive shell. The transducer is coupled to a preamplifier within the shell that amplifies the transducer signal for transmission by a cable to a receiver. The preamplifier, transducer, and one end of the cable are encapsulated within the shell to support and protect the assembly.

6 Claims, 2 Drawing Sheets

ACOUSTIC SENSOR HAVING A SHELL-MOUNTED TRANSDUCER

FIELD OF THE INVENTION

This invention relates generally to acoustic sensors and, more particularly, to acoustic sensors employing piezoelectric polymer transducers within acoustically transmissive shells.

BACKGROUND OF THE INVENTION

Acoustic sensors are used in numerous applications to detect and monitor acoustic disturbances in transmissive media. For example, given the good acoustic transmission characteristics of water, hydrophones allow the subsurface activity of a variety of subjects including marine mammals and submarines to be conveniently monitored. Similarly, microphones are commonly used to convert acoustic transmissions through air into electric signals for reproduction and analysis. When appropriately attached to a solid structure, such sensors can even be used to monitor the exposure and reaction of the structure to vibration.

In each of these applications, it may be desirable to employ an acoustic sensor exhibiting several particular characteristics. If the sensor is to respond to a broad range of acoustic transmissions, it should have a wide bandwidth. In addition, the sensor preferably will exhibit a relatively flat response to transmissions throughout its bandwidth, ensuring that transmissions of equal amplitude are interpreted equally. If the sensor is to provide accurate, easily interpreted information, it should also exhibit a relatively high signal-to-noise ratio. Further, in certain applications the sensor may be subject to conditions that require it to be relatively rugged and impervious to its environment. Finally, it would be desirable to provide an acoustic sensor that is relatively inexpensive and simple in construction.

SUMMARY OF THE INVENTION

In accordance with this invention, an acoustic sensor is disclosed that includes an acoustically transmissive shell having an inner surface and an outer surface. Secured to the inner surface of a portion of the shell is a piezoelectric polymer transducer for receiving acoustic energy through the shell and for producing an electric signal in response thereto. In accordance with a particular aspect of this invention, the shell comprises a cylindrical body, and the transducer comprises a piezoelectric polymer tape that is circumferentially secured to the inner surface of the cylindrical body. A preamplifier is located within the shell for amplifying the electric signal produced by the transducer, to provide an output signal suitable for transmission. An encapsulant surrounds the transducer and preamplifier within the shell, and provides environmental resistance and mechanical strength to the sensor.

BRIEF DESCRIPTION OF THE DRAWINGS

The invention will presently be described in greater detail, by way of example, with reference to the accompanying drawings, wherein.

DETAILED DESCRIPTION OF A PREFERRED EMBODIMENT OF THE INVENTION

Figure 1:
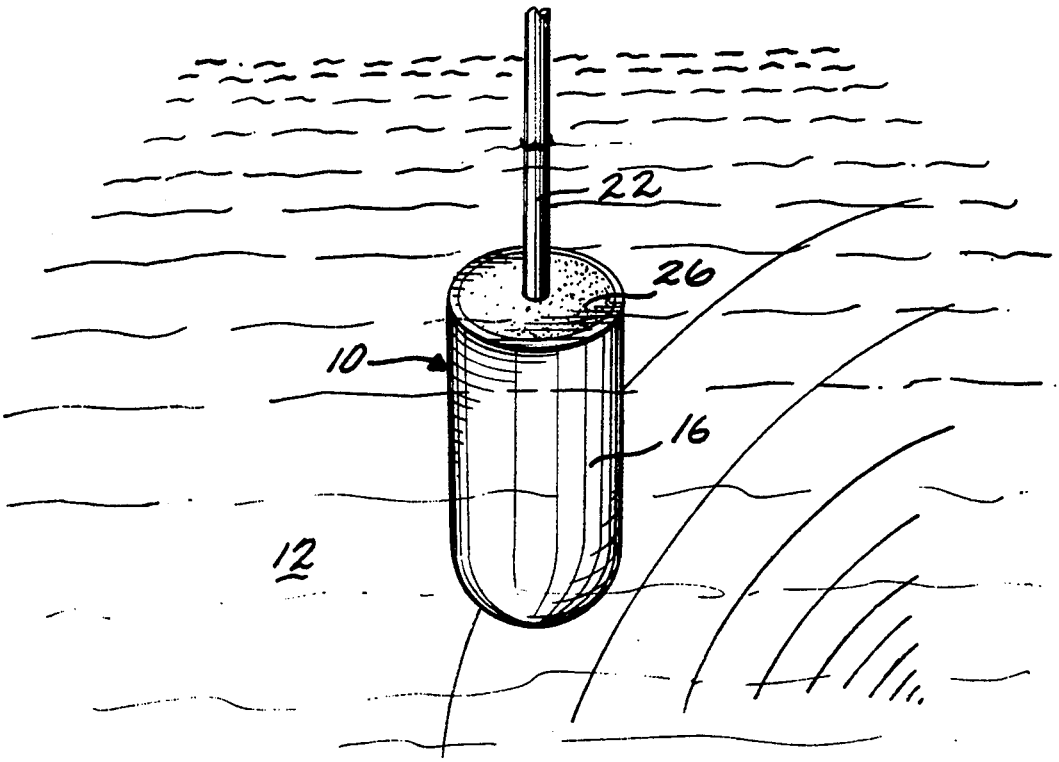
FIG. 1 is pictorial view of an acoustic sensor constructed in accordance with this invention for the nondirectional detection of acoustic energy and including a piezoelectric polymer transducer encapsulated within an acoustically transmissive shell.

Referring now to FIG. 1, an acoustic sensor constructed in accordance with this invention is shown for use as a hydrophone 10. As illustrated, hydrophone 10 is suspended in an acoustically transmissive medium such as water 12. When acoustic transmissions impinge on hydrophone 10, the acoustic energy is converted into an electric signal that is conducted via cable 22 to a monitoring site, such as a ship above the surface of water 12. This signal is suitable in nature for direct connection to tape recorders and analyzing equipment. In this manner, the emissions of subsurface acoustic signal sources can be conveniently detected, monitored and analyzed.

Figure 2:
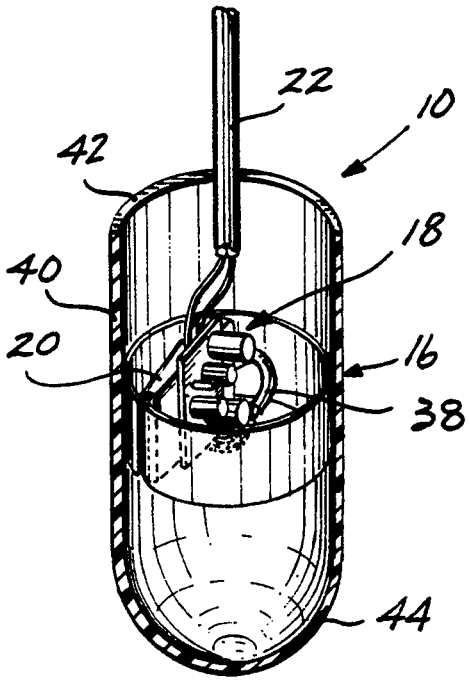
FIG. 2 is a pictorial view, in partial section, of the sensor depicted in FIG. 1, showing the internal structure of the sensor without the encapsulant and weights.
Figure 3:
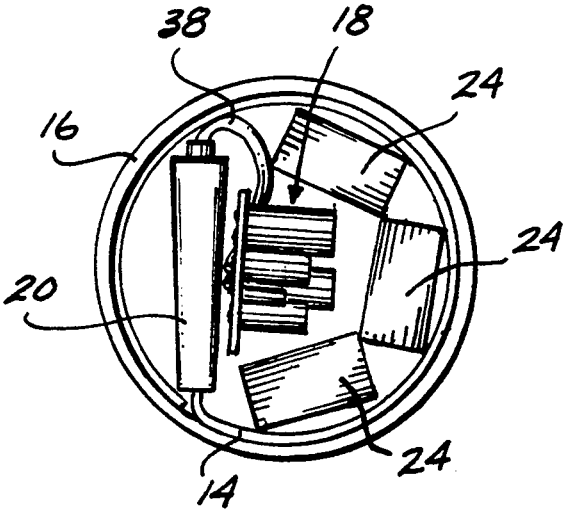
FIG. 3 is a cross-sectional view of the sensor without the encapsulant, showing the weights.

As shown in FIGS. 2 and 3, hydrophone 10 includes a piezoelectric polymer transducer 14, which performs the conversion of acoustic energy into an electric signal. Transducer 14 is directly secured to a shell 16, which supports and protects the various components of hydrophone 10. Shell 16 includes a cylindrical body section 40 that is open at a top end 42 and closed at a bottom end 44 by a hemispherical surface. Transducer 14 is electrically connected to a preamplifier 18 by adaptor 20 and a low capacitance shielded cable 38. The preamplifier 18 converts the very high impedance of transducer 14 into a low impedance, and amplifies the electric signal produced by transducer 14 sufficiently for transmission to the surface through a cable 22. Weights 24 (not shown in FIG. 2) are included to give the hydrophone 10 negative buoyancy. As shown in FIG. 3, weights 24 are wedged between preamplifier 18 and transducer 14. The transducer 14, preamplifier 18, adaptor 20, weights 24, and the lower end of cable 22 are secured within shell 16 by encapsulant 26 as indicated in FIG. 1.

Addressing the various components of hydrophone 10 in greater detail, as noted previously, transducer 14 converts acoustic energy impinging on hydrophone 10 into an electric signal. As shown in FIGS. 2 and 3, transducer 14 is adhered circumferentially to the inner surface of shell 16 with the aid of adhesive or double-sided tape. It is important that the adhesion be complete and the contact between transducer 14 and shell 16 be uniformly intimate, because air gaps between the two will introduce acoustic losses that significantly impair the operation of the hydrophone. In this arrangement shown in the Figures, hydrophone 10 is constructed for "nondirectional" operation, inasmuch as transducer 14 responds to acoustic transmissions received from any direction in a horizontal plane normal to the longitudinal (i.e., vertical) axis of the hydrophone. By adhering transducer 14 directly to the inner surface of shell 16, the attenuation of acoustic energy that would otherwise result from the presence of an air gap or encapsulant is eliminated.

Transducer 14 is made from a piezoelectric polymer material. While conventional ceramic piezoelectric materials such as lead titanate zirconate typically have a higher nominal sensitivity than piezoelectric polymer materials, this advantage is more than offset by ceramic materials susceptibility to damage or destruction from physical shock. In contrast, piezoelectric polymers exhibit no shock-induced failure modes, and are thus ideal for applications where this type of damage potential exists. A further advantage of piezoelectric polymers is that they exhibit very broad frequency bandwidth, typically greater than 1 MHz.

The currently preferred material for use in transducer 14 is marketed under the name C-TAPE by C-TAPE Developments, Ltd., 3050 S. W. 14th Place, Boynton Beach, Fla. 33435. This material is the subject of U.S. Pat. No. 4,389,580, hereby incorporated by reference. A transducer constructed from this material includes an internal flat metal foil surrounded by a dielectric tape or electret that, in turn, is surrounded by an outer metal foil. Electrical connections to the foils are provided by leads supported in an injection molded adaptor 20, which leads are in turn coupled to the preamplifier via cable 38. Cable 38 is a single conductor shielded cable that conducts electric signals from the transducer to preamplifier 18. As will be appreciated, when transducer 14 is exposed to acoustic energy, the piezoelectric nature of the electret results in the production of an electric signal on cable 38 that is indicative of the acoustic energy impinging on transducer 14.

In a preferred embodiment of the nondirectional hydrophone shown in the Figures, transducer 14 is a strip of C-TAPE material of sufficient length to extend completely around the inner surface of shell 16. Such a transducer can be constructed to have a linear bandwidth extending approximately from DC to 5 MHz, and a sensitivity of approximately −90 dB, ref 1 $VPa^{-1}$. As will be appreciated, although hydrophone 10 is designed as an acoustic sensor, the bandwidth of transducer 14, as limited by the structure of hydrophone 10, makes it possible for hydrophone 10 to also respond electrically to infrasonic and ultrasonic transmissions.

As noted previously, the function of preamplifier 18 is to amplify the signal produced by transducer 14 sufficiently for transmission through cable 22. In the illustrated embodiment, preamplifier 18 is an arrangement of discrete components soldered to a printed circuit board. The preamplifier 18 employs a field-effect transistor (FET), selected to allow low noise operation. The preamplifier preferably exhibits very high input impedance, low noise, low distortion, and wide bandwidth. The output impedance should be low, to allow The preamplifier to drive long cables and interface directly to the microphone inputs of tape recorders or analyzers. The preamplifier may advantageously be designed to operate over a 6–24 volts DC range by adjustment of a resistor. As will be appreciated, the details of the preamplifier construction are determined in part by the requirements of the particular hydrophone design employed. In the preferred arrangement, however, preamplifier 18 has a gain of 15 db, a frequency range of 1 Hz to 200 KHz, a signal-to-noise ratio of 96 dB, a total harmonic distortion plus noise of approximately 0.06%, and an intermodulation distortion of 0.004%.

After being amplified by preamplifier 18, the transducer signal is applied to transmission cable 22 for transmission to the surface. Suitable hydrophone cables are manufactured to include multiple conductors in a water-blocked matrix, with a heavy-duty braided shield and a thick Hypalon jacket.

Shell 16 provides a housing for transducer 14, preamplifier 18, adaptor 20 and the end of cable 22, and also provides an attachment surface for transducer 14. The shell is designed to offer a suitable combination of mechanical protection and acoustic impedance. More particularly, shell 16 must be sufficiently thin to minimize acoustical losses, and composed of a material that minimizes acoustical losses, while simultaneously providing mechanical protection for transducer 14. In a preferred arrangement, shell 16 is made of irradiated polyolefin with a length of 3 inches (7.62 cm), a diameter of 2 inches (5.08 cm), and a wall thickness of 0.02 inches (0.05 cm). Transducer 14 is circumferentially adhered to the inner surface of shell 16 approximately one-half way between bottom end 44 and the open top end 42.

To construct the hydrophone, the leads of cables 22 and 38 are soldered to an assembled preamplifier 18. 100% foil shielding is then applied by wrapping the foil around the assembly. The shielded assembly is inserted into shell 16, and weights 24 are positioned around the assembly to wedge it in place prior to encapsulation. The urethane encapsulant 26 is then dispensed into the shell 16, and the entire hydrophone assembly is then set aside for curing. As noted previously, the function of encapsulant 26 is to support and bond together the various components within hydrophone 10, and lend environmental resistance and overall strength to the hydrophone. The use of polyurethanes for encapsulant 26 is preferred for a number of reasons. First, urethanes are available that cure at room temperature, avoiding the exposure of transducer 14 and preamplifier 18 to potentially damaging temperatures during encapsulation. In addition, urethane bonds well to rubbers, neoprenes, and plastics, ensuring good adherence to, and support of, the various components of the hydrophone. This is particularly important to the accomplishment of a secure mechanical connection between cable 22 and the encapsulated assembly. Urethanes can be selected that are hydrolytically stable, making them suitable for prolonged submersion in water. In addition, urethane bonds well to rubbers, and is relatively inexpensive.

Although the preceding description focuses primarily upon the use of an acoustic sensor as a hydrophone 10, it will be appreciated that other applications for such a sensor exist. For example, the hydrophone can be used in any medium that allows direct contact between the medium in shell 16. Thus, the hydrophone may be used in oils, gels, and other nongaseous compounds.

Those skilled in the art will recognize that the embodiments of the invention disclosed herein are exemplary in nature and that various changes can be made therein without departing from the scope and the spirit of the invention. Further, it will be recognized that the sensor can be constructed for various modes of operation, including nondirectional and directional use. Similarly, the details of various components, such as the preamplifer which can be constructed in integrated circuit form, can be varied. Because of the above and numerous other variations and modifications that will occur to those skilled in the art, the following claims should not be limited to the embodiments illustrated and discussed herein.

The embodiments of the invention in which an exclusive property or privilege is claimed are defined as follows:

1. An acoustic sensor comprising:

an acoustically transmissive shell having an inner surface and an outer surface, the shell including a cylindrical body having a first end that is closed, a second end that is open, and a longitudinal axis; and a transducer comprising a piezoelectric polymer tape, circumferentially secured to the inner surface of the body, for receiving acoustic energy through the shell from one or more directions normal to the axis and producing an electric signal in response thereto.

2. The acoustic sensor of claim 1, wherein the thickness of the shell as measured between the inner surface and the outer surface is dimensioned to provide both adequate mechanical protection for the transducer and low attenuation of acoustic energy received by the transducer through the shell.

3. The acoustic sensor of claim 2, further comprising:

a preamplifier, located within the shell, for amplifying the electric signal produced by the transducer to provide an output signal suitable for transmission;

means for electrically coupling the preamplifier to the transducer; and a cable, electrically coupled to the preamplifier and extending from the shell, for transmitting the output signal provided by the preamplifier.

4. The acoustic sensor of claim 3, further comprising an encapsulant for surrounding the transducer and preamplifier within the shell.

5. The acoustic sensor of claim 4, wherein the encapsulant comprises urethane.

6. An acoustic sensor comprising:

an acoustically transmissive shell having an inner surface and an outer surface, the shell comprising an irradiated polyolefin, the thickness of the shell as measured between the inner surface and the outer surface being dimensioned to provide both adequate mechanical protection for the transducer and low attenuation of acoustic energy received by the transducer through the shell; and a piezoelectric polymer transducer secured to the inner surface of a portion of the shell, for receiving acoustic energy through the shell and producing an electric signal in response thereto.

* * * * *